US008597721B2

(12) United States Patent
Idrizovic et al.

(10) Patent No.: US 8,597,721 B2
(45) Date of Patent: Dec. 3, 2013

(54) TOUCH FASTENER CONFIGURATION AND MANUFACTURING

(71) Applicant: Velcro Industries B.V., Willemstad (NL)

(72) Inventors: Almin Idrizovic, Manchester, NH (US); James T. Grady, Chester, NH (US); Bob Yusuo Chang, Bedford, NH (US); Mark A. Clarner, Concord, NH (US)

(73) Assignee: Velcro Industries B.V., Willemstad, Curacao ( * ) Notice: Subject to any disclaimer, the term of this patent is extended or adjusted under 35 U.S.C. 154(b) by 0 days.

(21) Appl. No.: 13/660,294

(22) Filed: Oct. 25, 2012

(65) Prior Publication Data

US 2013/0059111 A1 Mar. 7, 2013

Related U.S. Application Data

(63) Continuation of application No. PCT/US2011/033894, filed on Apr. 26, 2011.

(60) Provisional application No. 61/328,454, filed on Apr. 27, 2010.

(51) Int. Cl.
*B32B 3/06* (2006.01)

(52) U.S. Cl.
USPC ..... 427/100; 24/448; 24/447; 24/451

(58) Field of Classification Search
USPC ..... 428/100; 24/448, 447, 451
See application file for complete search history.

(56) References Cited

U.S. PATENT DOCUMENTS

| | | | |
|---|---|---|---|
| 27,725 | A | 4/1860 | Lane |
| 3,666,695 | A | 5/1972 | Jachimowicz et al. |
| 3,708,382 | A | 1/1973 | Erb |
| 4,239,829 | A | 12/1980 | Cohen |
| 4,761,318 | A | 8/1988 | Ott et al. |
| 4,770,917 | A | 9/1988 | Tochacek et al. |
| 5,436,051 | A | 7/1995 | Donaruma et al. |
| 5,516,183 | A | 5/1996 | Gold |
| 5,605,729 | A | 2/1997 | Mody et al. |

(Continued)

FOREIGN PATENT DOCUMENTS

| | | | |
|---|---|---|---|
| JP | 2005312707 | A | 11/2005 |
| WO | WO2004052745 | A1 | 6/2004 |

OTHER PUBLICATIONS

International Search Report and Written Opinion for International Application No. PCT/US2011/33894 mailed Jul. 8, 2011 (12 pages).

*Primary Examiner* — Michael C Miggins
(74) *Attorney, Agent, or Firm* — Fish & Richardson P.C.

(57) ABSTRACT

A touch fastener product has a base strip of resin carrying both mechanical fastener projections and adhesive, in some cases disposed on raised portions of the base strip. The fastener projections are arranged in discrete fields with lanes between the fields, and the adhesive is disposed within the lanes. The adhesive in each lane is shorter, as measured perpendicularly from the base strip, than the projections nearest the lane, by a distance that is less than ten percent of the width of the lane. In some cases molded stems extend through the adhesive in the lanes. The fastening face of the molded base strip is treated to give the fastening face a higher surface energy than the back face, to resist adhesive delamination during unspooling.

31 Claims, 4 Drawing Sheets

(56) References Cited

U.S. PATENT DOCUMENTS

| | | | | |
|---|---|---|---|---|
| 5,636,414 | A | 6/1997 | Litchholt | |
| 5,656,351 | A | 8/1997 | Donaruma | |
| 5,725,423 | A | 3/1998 | Barry et al. | |
| 5,926,926 | A | 7/1999 | Kato | |
| 5,962,102 | A | 10/1999 | Sheffield et al. | |
| 6,086,973 | A | 7/2000 | Hazes | |
| 6,202,260 | B1 * | 3/2001 | Clune et al. | 24/30.5 R |
| 6,203,645 | B1 | 3/2001 | Gilpatrick | |
| 6,393,673 | B1 | 5/2002 | Kourtidis et al. | |
| 6,402,730 | B1 | 6/2002 | Malowaniec | |
| 6,428,525 | B1 | 8/2002 | Malowaniec | |
| 6,460,229 | B1 | 10/2002 | Schulte | |
| 6,463,634 | B1 | 10/2002 | Naohara et al. | |
| 6,681,457 | B2 | 1/2004 | Okawa et al. | |
| 6,701,580 | B1 | 3/2004 | Bandyopadhyay | |
| 6,884,157 | B2 | 4/2005 | Chesley et al. | |
| 6,913,810 | B2 | 7/2005 | Wang et al. | |
| 7,013,536 | B2 | 3/2006 | Golden et al. | |
| 7,282,251 | B2 | 10/2007 | Provost et al. | |
| 7,407,496 | B2 | 8/2008 | Petersen | |
| 2005/0060849 | A1 * | 3/2005 | Vanbenschoten et al. | 24/451 |
| 2006/0110562 | A1 | 5/2006 | Roberts et al. | |
| 2007/0039142 | A1 | 2/2007 | Petersen et al. | |
| 2009/0068393 | A1 | 3/2009 | Homolle et al. | |
| 2009/0217492 | A1 | 9/2009 | Gallant et al. | |

* cited by examiner

TOUCH FASTENER CONFIGURATION AND MANUFACTURING

CROSS REFERENCE TO RELATED APPLICATIONS

This application is a continuation of and claims priority under 35 U.S.C. §120 to PCT Application PCT/US2011/033894, filed Apr. 26, 2011, which claimed priority to U.S. Provisional Application No. 61/328,454, filed Apr. 27, 2010. The contents of both of these priority applications are hereby incorporated by reference in their entirety.

TECHNICAL FIELD

This invention relates to touch fasteners with both discrete mechanical fastener projections and adhesive, and to their configuration, methods of manufacturing and their use in products.

BACKGROUND

Touch fasteners may have arrays of discrete mechanical fastener projections, such as hooks for releasably engaging fibers, or adhesives with tacky exposed surfaces, or both. Touch fasteners find use in several types of products, including on fastening tabs of disposable diapers. For most applications, touch fasteners should be refastenable after being released, and should be able to undergo a number of fastening cycles without losing their fastening ability. Fastening ability or performance is often measured in terms of the ability to resist peel and shear loads, and is a function of the characteristics of both fastening surfaces. It is particularly difficult to obtain high fastening ability when mating mechanical fastener projections with inexpensive, low-loft materials, such as the non-woven materials from which diaper outer covers are commonly manufactured.

One general need is for improvements in fastening performance, particularly when forming a fastening with a low-loft, lightweight fibrous material. It is also generally desirable to do so at relatively low cost and while maintaining a good feel of the fastener product against skin.

SUMMARY

Many aspects of the invention feature a touch fastener product with a combination of mechanical fastener projections and exposed adhesive. Various aspects feature particular configurations of the relative positioning of fastener projections adhesive.

For example, one aspect of the invention features a touch fastener product with a base strip of resin, touch fastener projections extending from a fastening side of the base strip and arranged as fields of projections extending along opposite sides of a lane between the fields, and a layer of adhesive disposed on the fastening side of the base strip within the lane. The base strip and fastener projections together form a single, contiguous mass of resin.

The lane has a width, measured between near edges of the fields of fastener projections, and the layer of adhesive is shorter, as measured perpendicularly from the base strip, than the touch fastener projections nearest the lane, by a distance that is less than ten percent of the width of the lane.

In some embodiments, the fastening face has a portion raised with respect to adjacent regions of the fastening face within the lane, and the layer of adhesive is disposed on an outer surface of the raised portion of the fastening face.

Some examples of the product also include a series of discrete, non-fastening stems extending from the base strip through the layer of adhesive within the lane, the resin stems forming portions of the single, contiguous mass of resin.

In some cases, the fields of touch fastener projections define multiple spaced apart lanes, each lane defined between a respective pair of fields, with the layer of adhesive including multiple portions of adhesive, each portion disposed within a respective one of the lanes.

For some applications each lane is wider, measured between near edges of the fields of fastener projections that the lane separates, than each of the fields of fastener projections nearest the lane.

In some embodiments the fastener projections are each configured to engage and retain fibers. For example, the fastener projections may each have a molded stem extending from the base strip to a head overhanging the base strip. In some cases each fastener projection head extends laterally in opposite directions to two distal tips. Each fastener projection head may extend to a distal tip disposed at an elevation of an upper extent of the adhesive layer.

In some configurations the layer of adhesive is domed. In some other configurations, the layer of adhesive is of substantially rectangular cross-section.

In some arrangements, each field of fastener projections has multiple parallel rows (e.g., three rows) of fastener projections.

Preferably, the fastener projections are of an overall height, measured perpendicularly from the base strip, of less than about 0.020 inch (0.5 mm).

For some uses, the lane width is less than about 4 millimeters, or even less than about 3 millimeters, and each fastener projection field has a width of less than about 2 millimeters.

Another aspect of the invention features a touch fastener product having a base strip of resin with a fastening face and a back face, the fastening face having a portion raised with respect to adjacent regions of the fastening face. Touch fastener projections extend from the fastening face of the base strip and are arranged as fields of projections disposed on opposite sides of the raised portion of the fastening face. The projections extend from the base strip to a height above the raised portion, and the base strip and fastener projections together form a single, contiguous mass of resin. A layer of adhesive is disposed on an outer surface of the raised portion of the fastening face.

In some embodiments the outer surface of the raised portion is flat.

Preferably, the raised portion of the fastening face has a height, measured perpendicular to adjacent portions of the fastening face, that is less than half the height of the projections.

In some cases, the layer of adhesive has an exposed outer surface disposed below tops of the projections.

In some embodiments the fastener projections are each configured to engage and retain fibers. For example, the fastener projections may each have a molded stem extending from the base strip to a head overhanging the base strip. In some cases each fastener projection head extends laterally in opposite directions to two distal tips. Each fastener projection head may extend to a distal tip disposed at an elevation of an upper extent of the adhesive layer.

In some configurations the layer of adhesive is domed. In some other configurations, the layer of adhesive is of substantially rectangular cross-section.

In some arrangements, each field of fastener projections has multiple parallel rows (e.g., three rows) of fastener projections.

Preferably, the fastener projections are of an overall height, measured perpendicularly from the base strip, of less than about 0.020 inch (0.5 mm).

For some uses, the lane width is less than about 4 millimeters, or even less than about 3 millimeters, and each fastener projection field has a width of less than about 2 millimeters.

Another aspect of the invention features a touch fastener product with a base strip of resin, touch fastener projections extending from a fastening side of the base strip and arranged as fields of projections extending along opposite sides of a lane between the fields, and a layer of adhesive disposed on the fastening side of the base strip within the lane. The base strip and fastener projections together form a single, contiguous mass of resin. A series of discrete, non-fastening stems extend from the base strip through the layer of adhesive within the lane, the resin stems forming portions of the single, contiguous mass of resin.

In some embodiments, the non-fastening stems have adhesive disposed on their distal ends In some cases the non-fastening stems have distal ends that are exposed above the layer of adhesive.

For some applications the non-fastening stems extend perpendicularly from the base strip.

The non-fastening stems are taller than the touch fastener projections, in some examples.

In some configurations the non-fastening stems are arranged in at least one row of spaced-apart stems. For example, the non-fastening stems may be arranged in multiple, spaced-apart rows of stems within the lane.

In some embodiments the fastener projections are each configured to engage and retain fibers. For example, the fastener projections may each have a molded stem extending from the base strip to a head overhanging the base strip. In some cases each fastener projection head extends laterally in opposite directions to two distal tips. Each fastener projection head may extend to a distal tip disposed at an elevation of an upper extent of the adhesive layer.

In some configurations the layer of adhesive is domed. In some other configurations, the layer of adhesive is of substantially rectangular cross-section.

In some arrangements, each field of fastener projections has multiple parallel rows (e.g., three rows) of fastener projections.

Preferably, the fastener projections are of an overall height, measured perpendicularly from the base strip, of less than about 0.020 inch (0.5 mm).

For some uses, the lane width is less than about 4 millimeters, or even less than about 3 millimeters, and each fastener projection field has a width of less than about 2 millimeters.

Another aspect of the invention features a touch fastener product with a base strip of resin, touch fastener projections extending from a fastening side of the base strip and arranged as discrete fields of projections separated by lanes between adjacent fields, and adhesive disposed on the fastening side of the base strip within the lanes. The base strip and fastener projections together form a single, contiguous mass of resin. Each discrete field has multiple, spaced-apart rows of fastener projections extending along the base strip, the fastener projections each extending to a height higher than the adhesive. Each lane is wider, measured between near edges of the fields of fastener projections that the lane separates, than a spacing between adjacent rows of fastener elements in the fields of fastener projections the lane separates.

In some embodiments, the adhesive within each lane is arranged in a strip narrower than the lane, such that in each lane the adhesive strip has longitudinal edges spaced from the fields of fastener projections that the lane separates. Each strip of adhesive may have a width less than 2 millimeters, and each field of fastener projections may have a width less than 2 millimeters.

In some embodiments the fastener projections are each configured to engage and retain fibers. For example, the fastener projections may each have a molded stem extending from the base strip to a head overhanging the base strip. In some cases each fastener projection head extends laterally in opposite directions to two distal tips. Each fastener projection head may extend to a distal tip disposed at an elevation of an upper extent of the adhesive layer.

In some configurations the layer of adhesive is domed. In some other configurations, the layer of adhesive is of substantially rectangular cross-section.

In some arrangements, each field of fastener projections has multiple parallel rows (e.g., three rows) of fastener projections.

Preferably, the fastener projections are of an overall height, measured perpendicularly from the base strip, of less than about 0.020 inch (0.5 mm).

For some uses, the lane width is less than about 4 millimeters, or even less than about 3 millimeters, and each fastener projection field has a width of less than about 2 millimeters.

Another aspect of the invention features a method of forming a touch fastener product. The method includes forming, of a contiguous mass of resin, a base strip and an array of projections extending from a fastening face of the strip; treating at least a portion of the fastening face of the strip with a plasma, thereby providing the treated portion with a higher surface energy than of a back face of the strip opposite the fastening face; bonding an adhesive to the treated portion of the fastening face, thereby forming a fastener strip having an exposed adhesive; and then spooling the fastener strip such that the back face of the strip lies against the fastening face of an adjacent winding of the strip.

In some examples the resin is or includes polypropylene.

In some cases, treating at least a portion of the fastening face of the strip with a plasma involves treating the entire fastening face of the strip.

In some embodiments the treatment is done with an atmospheric chemical plasma treating system.

Preferably, the treatment involves raising a surface energy of the resin to more than about 50 dynes per centimeter.

In some examples the base strip is formed between two counter-rotating rollers.

Forming the array of projections may involve, for example, molding the projections in respective mold cavities and stripping the molded projections from the cavities.

The method includes, in some instances after bonding the adhesive, curing the adhesive prior to spooling the fastener strip.

The adhesive may be applied in parallel strips spaced apart across a width of the fastening face, for example, and may be applied in lanes between fields of the projections.

In some embodiments the treatment involves treating surfaces both of the base strip and of the projections.

In some cases the projections are each a fastener projection with a head overhanging the base strip. In some instances the fastener projection heads are formed prior to treating with the plasma. Treatment with the plasma may include treating the fastener projections Some aspects of the invention provide a fastening face that features a particularly useful cooperation of mechanical and adhesive fastening, while at the same time enabling liner-less spooling and unspooling of the product. The mechanical fastening performance is enhanced by the proximity of mechanical and adhesive fastening means, and the relatively low height difference between adhesive and mechanical elements. The contribution of the adhesive to the fastening performance, particularly when mated with low-loft fibrous surfaces such as diaper chasses, is aided by the relatively small ratio of height difference to adhesive lane width. Using particularly narrow adhesive lanes may also enable the use of adhesives of higher tackiness without destroying inexpensive fibrous materials.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
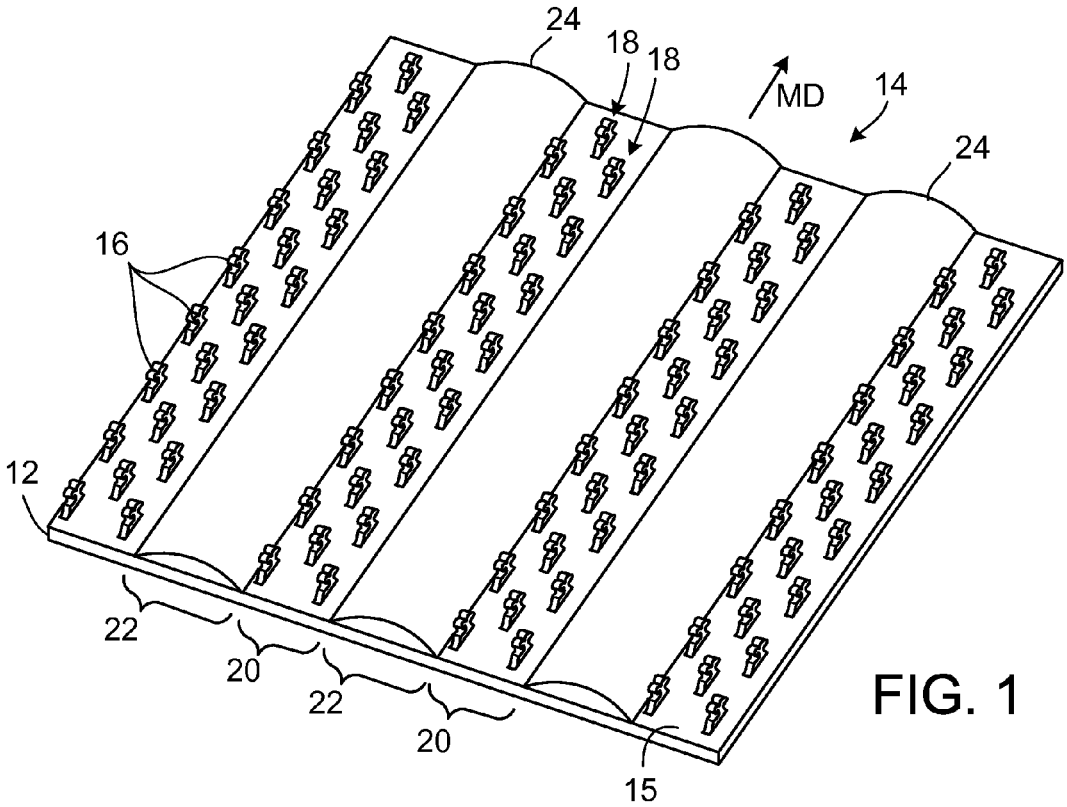
FIG. 1 is a perspective view of a touch fastener product.

Referring first to FIG. 1, a strip-form or sheet-form touch fastener product 10 has a flexible base strip 12 of resin having a broad fastening side 14 featuring a surface 15 from which an array of discrete fastener projections 16 extend. Base strip 12 and fastener projections 16 are preferably formed by a continuous molding process of a single flow of resin, such that the base strip and fastener projections together form a unitary and seamless resin mass, with the fastener projections extending contiguously and integrally with the upper surface 15 of the base strip. Such a unitary structure can be molded, for example, using a rotating mold roll defining a large number of discrete fastener projection-shaped cavities about its periphery, as taught by Fischer in U.S. Pat. No. 4,872,243, the entire contents of which are incorporated herein by reference, and as discussed below. The machine direction of such a process would normally be as illustrated by arrow 'MD', for example.

In this configuration, fastener projections 16 are arranged in spaced-apart rows 18 extending in the machine direction MD, the discrete projections 16 of each row spaced apart along the row. The projections 16 are further arranged as fields 20 of projections extending along opposite sides of lanes 22 between the fields and void of fastener projections. Disposed on the fastening side 14 of the base strip within each lane 22 is a layer of adhesive 24 that cooperates with the adjacent fields of fastener projections to engage and retain fibers of a mating fastener surface (not shown).

Figure 2:
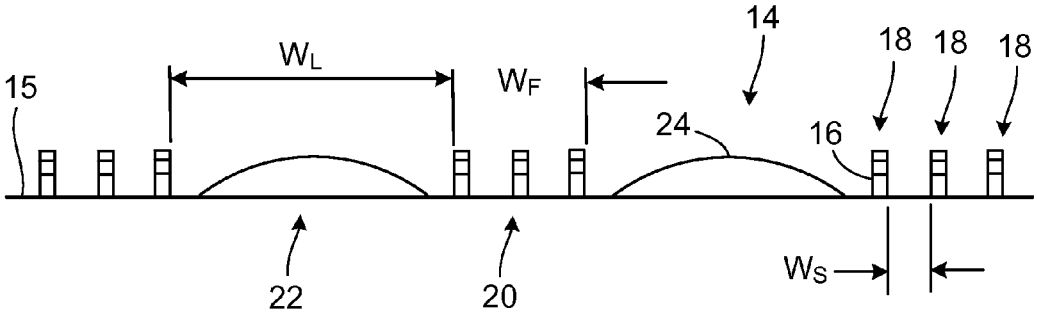
FIG. 2 is an enlarged end view of a portion of the product of FIG. 1.

Referring to FIG. 2, each lane 22 has a width $W_L$, measured between near edges of the fields of fastener projections, of about 2.0 millimeters, while each field 20 has a width $W_F$, measured between its outwardly facing fastener projection surfaces, of 0.91 millimeter, and the adjacent rows 18 of each field are spaced apart by a distance $W_S$ of 0.012 inch (0.3 mm). Each lane 22 is wider, then, than the spacing between adjacent rows of fastener elements in the fields of fastener projections the lane separates. In this example, there are three rows 18 of fastener projections 16 in each field 20, but other field configurations are envisioned. Furthermore, the fields need not each have the same number or type of fastener projections, or the same number of rows.

Figure 3:
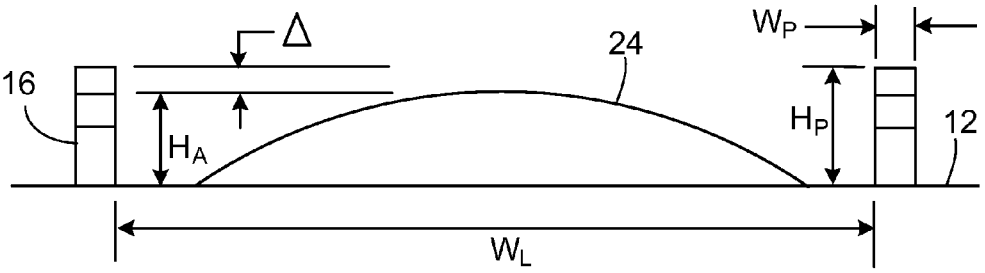
FIG. 3 is a magnified view showing one of the adhesive channels of the product of FIG. 1.

Referring to FIG. 3, the layer of adhesive 24 has a height $H_A$, as measured perpendicularly from the base strip 12, of about 0.01 inch (0.25 mm). It will be understood that this height will vary somewhat along the length of the strip, and from lane to lane, due to manufacturing variability. The adhesive dimensions given herein, unless otherwise specified, are average values. By comparison, the fastener projections 16 each have a height $H_P$ of about 0.012 inch (0.3 mm), and a molded width $W_P$ of about 0.004 inch (0.1 mm). Thus, the difference $\Delta$ between the adhesive height and projection height is about 0.002 inch (0.05 mm). The overall width of the adhesive 24 in each lane may be, for example, about 1.0 mm. In most examples, the adhesive will be spaced from the adjacent fields of fastener projections by an exposed region of the upper surface of base strip 12.

Figure 4:
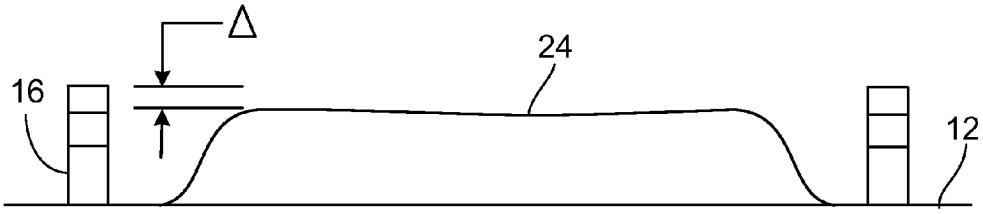
FIG. 4 shows a first alternate adhesive channel configuration.

The adhesive 24 in each lane may be applied so as to form a crowned bead, as shown in FIG. 3, or so as to form other cross-sectional configurations. For example, the adhesive 24 shown in the embodiment of FIG. 4 has a substantially rectangular cross-section of substantially greater width than height, and somewhat sloping sides. The wetting characteristics of the adhesive on the base strip surface, as applied, may cause the edges of the adhesive to feather outward, as shown in FIG. 4, or form a more distinct and abrupt edge. The adhesive 24 is configured such that surface fibers of a mating fibrous material, in particular a non-woven material with very low loft fibers, such as is typically employed as the outer cover of a disposable diaper, will adhere to the exposed outer surface of the adhesive while the adjacent fastener projections releasably engage the fibrous surface. One aspect of the configuration of the adhesive and fastener projections that is believed to be particularly advantageous for certain applications is that the difference $\Delta$ in height between the adhesive and projections, and the adhesive lane width $W_L$, is such that it does not require a great amount of displacement of the fastener projections into the fibrous surface, or flexure of the fabric surface down into the lane, to engage the adhesive with the surface fibers. In the examples shown in FIGS. 3 and 4, the ratio between height difference $\Delta$ and adhesive lane width $W_L$ is less than ten percent. In some configurations, this ratio is less than five percent.

Furthermore, it is believed that such early engagement of the adhesive with the fibrous surface during engagement can help to retain the projections against the surface as the projections engage and retain individual fibers, significantly enhancing the shear performance of the engagement, not only of the entire product but also of the fastener projection fields adjacent the adhesive. Configuring the adhesive and projections in rather narrow, alternating lanes provides an enhanced engagement effect for a majority of the fastener projections, and reduces the average continuous adhesion length for the fibers of the mating surface.

Preferably, the fastener product, with the adhesive and the fastener projections, develops at least 200 grams per inch of width (79 grams per cm of width) in peel, and at least 3,000 grams per square inch (460 grams per square cm) in tests performed in accordance with ASTM D5170-98 and ASTM D5169-98, respectively, when mated with low-loft nonwoven or lightweight knit materials such as are employed as the outer covers of disposable garments, such as the outer cover of PAMPERS CRUISERS diapers offered by Proctor & Gamble in 2010. It is also preferred that the fastener product exhibit at least such performance values when mated with FNL300 or FNL300M non-woven material or with material 3310, all available from Velcro USA Inc. of Manchester, N.H.

Figure 5:
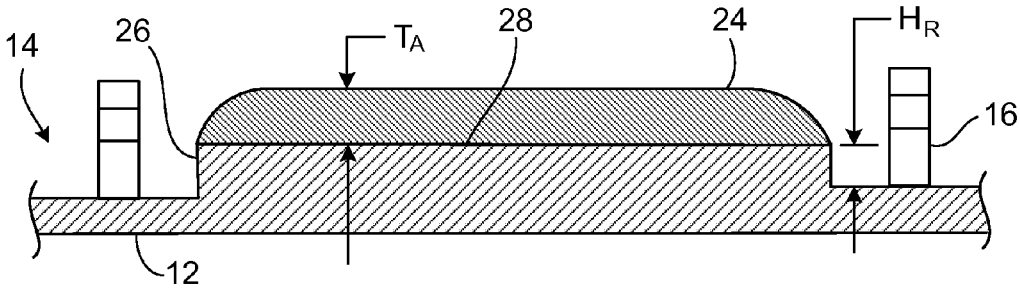
FIG. 5 shows a second alternate adhesive channel configuration, with a raised portion of the base strip.

In the above examples, the upper surface of base strip 12 is essentially planar, with the base strip having a relatively constant thickness, such as of about 0.005 inch (0.13 mm). In the example of FIG. 5, the fastening face 14 of base strip 12 has a raised portion 26 that is elevated with respect to adjacent regions of the fastening face. In the illustrated example, raised portion 26 has a rectangular cross-section and a flat outer surface 28, and corresponds to a local and discrete increase in the thickness of the base strip. This outer surface 28 carries the layer of adhesive 24 and has a height $H_R$, measured perpendicular to adjacent portions of the fastening face, that is less than half the height of the projections 16.

One of the intended benefits of placing the adhesive 24 on top of a raised portion 26 of the base strip is that less adhesive is required, while maintaining the exposed adhesive surface in the desired position for fibrous surface engagement. As the preferred adhesives are more expensive than a corresponding amount of base strip resin, this lowers material costs. Furthermore, reducing the thickness of the adhesive layer reduces the tendency toward cohesive delamination within the layer of adhesive during disengagement from the mating fibrous surface, and enables the use of low viscosity adhesives and certain application methods, as discussed below. The adhesive layer thickness $T_A$ in this example is only about 0.004 to 0.005 inch (0.10 to 0.13 mm), and as with the embodiments of FIGS. 3 and 4, the resulting height of the exposed surface of the adhesive is slightly below the height of the fastener projections.

Figure 6:
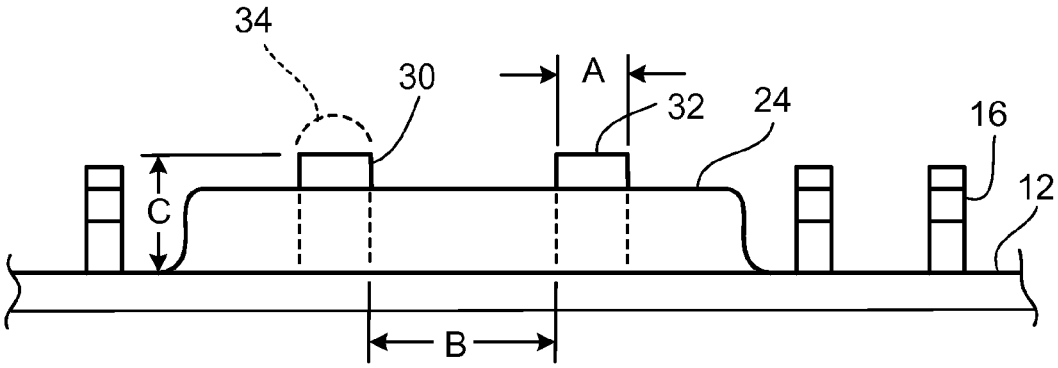
FIG. 6 shows a third alternate adhesive channel configuration, with molded stems disposed within the adhesive.

In the product shown in FIG. 6, the base strip 12 is molded with non-fastening stems 30 disposed within the lane in which the adhesive 24 is then applied. As they are molded with the base strip, stems 30 form portions of the same contiguous mass of resin forming the base strip and the fastener projections 16. The stems are 'non-fastening' in the sense that they do not appreciably add to the peel performance of the fastener, having no substantial overhang configured to retain fibers. They may, however, enhance shear performance by snagging fibers pulled across the fastening face, and may also enhance spool stability when spooling narrower products to relatively large spool diameters. The stems are arranged in rows extending parallel to the rows of fastener projections, and are spaced apart along their rows by a spacing about the same as the fastener projection spacing. In this illustrated example, only two rows of projections are shown, but other examples may include only one row of projections, or three or more rows. In this example, each discrete stem 30 is of square cross-section of dimension 'A' of about 0.008 inch (0.2 mm) and extend perpendicularly from the base strip 12, and the rows of stems are spaced apart by a distance 'B' of about 0.55 millimeter. The stems each rise to a height 'C' of about 0.014 inch (0.35 mm), such that the non-fastening stems 30 are taller than the touch fastener projections 16 and the distal ends 32 of the stems are exposed above the layer of adhesive 24. In some cases, applying the adhesive results in some adhesive 34 being deposited on the upper stem surfaces. Such adhesively-tipped stems may further enhance spool stability, and the adhesive may be applied in such manner than it is purposefully stripped from the stem ends during unspooling so as to leave the stem ends bare.

Figure 7:
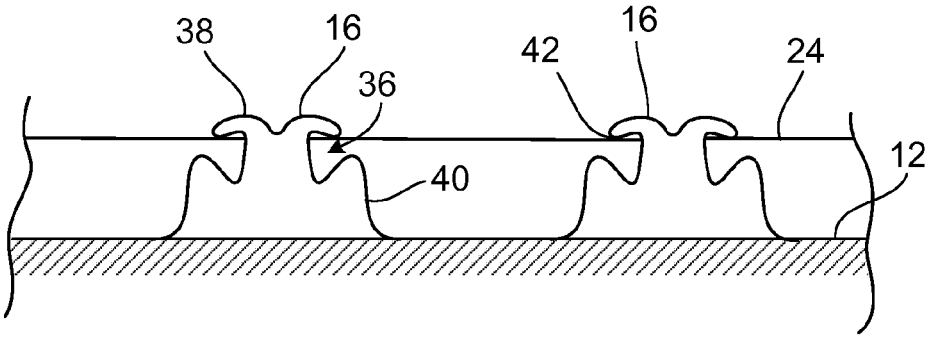
FIG. 7 is an enlarged side view of a portion of the product of FIG. 1.

FIG. 7 shows the side profile of the fastener projections 16 of the illustrated products discussed above. The type of fastener projection illustrated here is a 'palm-tree', in that it has two distinct crooks 36, each directed in a respective direction along the row. Each crook is bounded between an overhanging head 38 and a respective raised knee 40, and is generally disposed within the upper half of the fastener projection. The re-entrant tips 42 of the head are disposed at an elevation substantially the same as the height of the adhesive layer 24. More information concerning the structure of fastener projections 16, and their method of formation, is contained in Provost et al., U.S. Pat. No. 7,516,524, the entire contents of which are hereby incorporated by reference. Other projection types, such as J-hooks and mushrooms, are also suitable for some applications. In the illustrated examples, the projections are molded with overhanging heads, but suitable projections may also be formed by molding stems and later deforming distal ends of the stems to overhang the base strip for retaining fibers. The base strip and fastener projections may also be formed by extruding the base strip with rails shaped to have the desired fastener projection profile, then segmenting the rails and longitudinally stretching the base strip to separate the rail segments into discrete fastener projections. In such a case, the heads of the fastener projections would extend perpendicular to the rows of fastener projections in the final product.

Figure 8:
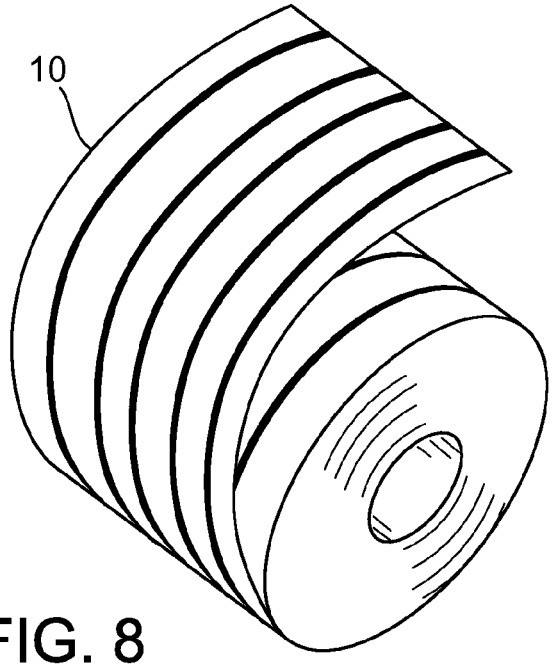
FIG. 8 shows a liner-less spool of touch fastener product.

Touch fastener products of the sort described above may be produced in a continuous process and spooled for shipment to another facility in which they are separated into discrete lengths, such as in the formation of diaper fastening tabs. When spooling and transporting products having an adhesive layer without a release liner, such as illustrated in FIG. 8, it is important that the adhesive not to adhere to the back surface of the overlying winding that it separates from the base strip as the product is unspooled. Some protection against such back surface adhesion is provided by making the fastener projections taller than the adhesive layer, and by configuring the width of the adhesive lanes with respect to the stiffness of the product, and the spooling tension, to avoid high pressure against the exposed adhesive surface during spooling and transport. Some additional protection is provided by providing discrete stems extending through the adhesive layer, as discussed above with respect to FIG. 6, that act as stand-offs to support the overlying winding on the spool without greatly diminishing shear performance of the product.

Depending on the application of the fastener product, there may be other situations that may cause the adhesive layer to undesirably separate from the base strip. For example, in some disposable diaper applications the fastener tab is either folded onto itself or onto a nonwoven tab surface, or engaged against another part of the diaper, during packaging and shipping. In such cases, it is important that when the fastener tab is unfolded or peeled from the diaper the adhesive layer is not stripped from the base strip. Furthermore, many applications require that the fastener be repositionable, in some cases many times without a significant degradation of fastening performance. For such applications it is important that the adhesive layer not delaminate during disengagement.

One method of enhancing the bond between the adhesive layer and the fastening face surface of the base strip is to treat the base strip surface prior to applying the adhesive, such as by plasma treating to raise the surface energy of the base strip where the adhesive is to be applied. In one example product configured as shown in FIGS. 1 through 3, the base strip and fastener projections were molded of polypropylene and then the fastening face of the molded strip was subjected to a plasma treatment that was not performed to the back face of the strip, such that the fastening face surface of the treated strip had a higher surface energy than the back surface. In one example, the surface energy of the treated fastening face was 58 dynes/cm, while the surface energy of the back face was less than 30 dynes/cm. In this example, the fastening face was treated by an atmospheric chemical plasma process in which the fastening face of the base strip was exposed to an atmosphere comprising 86% Helium, 9% Oxygen and 5% Acetylene, using a ceramic electrode energized with 6 kW at a frequency of 150 KHz and a gap of 0.045 inch (1.15 mm). A product treated with a lower concentration of oxygen was unable to hold its surface charge for a long enough period of time. The product passed by the electrode at a rate of 60 FPM (30 cm per second), and the energy applied to the base strip in the process was applied to a watt density of 20 watts per square foot per minute (3.6 $W/m^2/sec$). This process grafted or deposited specific functional groups to the polypropylene surface, while cleaning the surface by breaking down low molecular weight organic materials. The process resulted in some fine etching of the resin surface, without burning holes in the base strip or melting the molded fastener projections. Surface energy may be measured in accordance with ASTM D2578-04a.

Corona and flame plasma may be useful for some examples, but polypropylene does not respond as well to corona treatment and care must be taken with flame plasma to avoid damaging the fastener projections and/or stems. Plasma treatment may be performed after the fastener projections are fully formed, such as by molding, or may be performed after molding of preform fastener element stems, and the treated stems then deformed to form fastener projections.

The adhesive 24 shown in the figures may be a UV-cross-linkable acrylic, such as AROCURE Experimental UV Adhesive 634311 from Ashland Inc. of Covington, Ky. Such an acrylic may be cured in-line to dimensionally stabilize the adhesive and help to avoid delamination when unspooling. Another suitable adhesive is ACRYNAX 11891 Acrylic Polymer from Franklin Adhesives and Polymers of Columbus, Ohio, which is a permanently tacky, 100% solid acrylic polymer designed for use as a hot melt pressure sensitive adhesive. For some applications it may be necessary to increase the tackiness of the ACRYNAX adhesive. These materials are readily applied by hot melt coating equipment.

To form the product shown in FIG. 1, the ACRYNAX 11891 adhesive was applied at a temperature of 110 degrees Celsius and a viscosity of about 20,000 Centipoise, using a multi-aperture nozzle, each nozzle above a respective lane of the molded fastener tape. The tape traveled at a line speed of 90 feet per minute (450 cm per second) and the adhesive was deposited in strips of 0.040 to 0.050 inch (1.0 to 1.3 mm) in width and 0.009 to 0.011 inch (0.23 to 0.28 mm) in height. It was found that better results were obtained when lowering the die to just above the tape.

The adhesive shown in the example of FIG. 5 may be applied by roll coating, in which the adhesive is transferred directly onto the raised portions of the base strip by contoured roll. Each roll segment may be slightly wider than the width of the raised portion to account for process variation, due to the open spaces on either side of each raised portion. Roll application may enable even thinner layers of adhesive to be applied.

Figure 9:
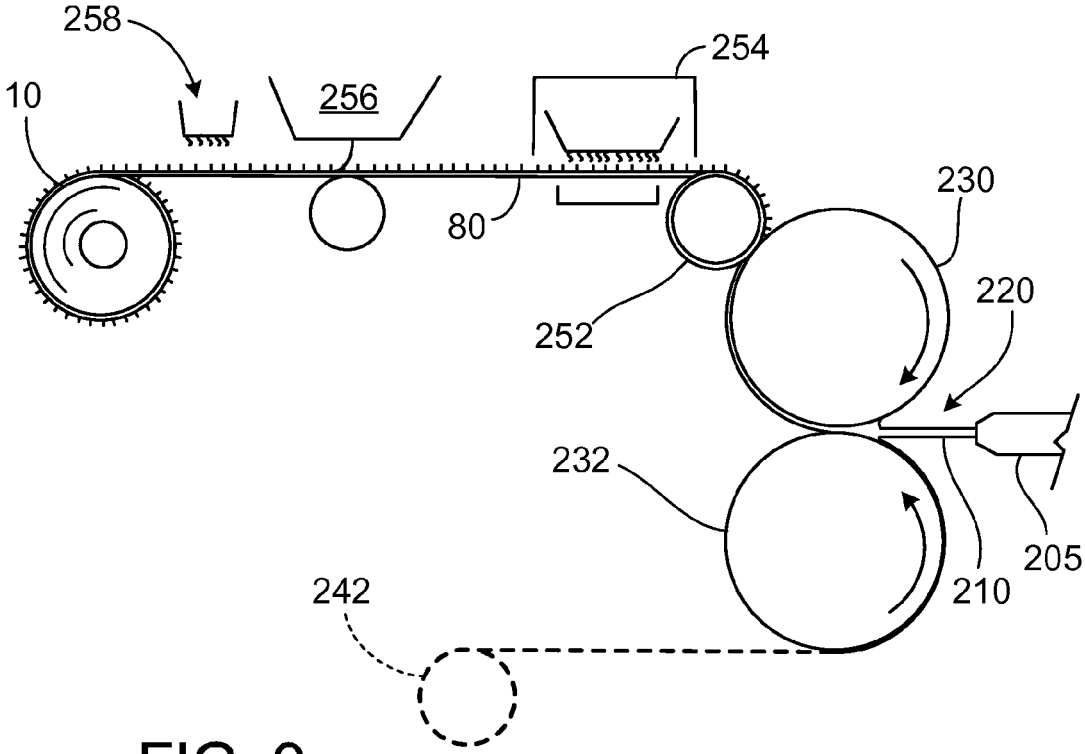
FIG. 9 schematically illustrates a method and apparatus for forming the illustrated touch fastener products.

An example of a continuous manufacturing method is illustrated schematically in FIG. 9. The base strip, fastener projections and any stems are molded by extruding molten resin 210 from extruder 205 into a nip 220 formed between two counter-rotating rolls 230 and 232. In the nip, under extreme roll pressure, the resin is forced into discrete cavities defined in the periphery of the mold roll 230 to mold the fastener projections (and any stems), while the base strip is formed between the roll surfaces. The mold roll surface may be channeled to produce any raised portions of the base strip. As discussed in Kennedy et al., U.S. Pat. No. 5,260,015, a web of material 242, such as a backing or reinforcement layer, may be trained into the nip with the resin so as to form a permanent part of the base strip. The resin is solidified while on the mold roll 230, and is then stripped from the surface of the mold roll by a stripper roll 252, pulling the molded fastener projections out of their respective cavities. The molded tape 80 is then passed through an atmospheric chemical plasma treating station 254 where the fastening face of the fastener strip is treated as discussed above, and then through an adhesive application station 256 where the adhesive is applied to the treated surface. If necessary, the adhesive is then cured in a UV curing station 258 before the final product 10 is spooled.

While a number of examples have been described for illustration purposes, the foregoing description is not intended to limit the scope of the invention, which is defined by the scope of the appended claims. There are and will be other examples and modifications within the scope of the following claims.

What is claimed is:

1. A touch fastener product comprising a base strip of resin;

touch fastener projections extending from a fastening side of the base strip and arranged as fields of projections extending along opposite sides of a lane between the fields, the base strip and fastener projections together forming a single, contiguous mass of resin; and a layer of adhesive disposed on the fastening side of the base strip within the lane;

wherein the lane has a width, measured between near edges of the fields of fastener projections; and wherein the layer of adhesive is shorter, as measured perpendicularly from the base strip, than the touch fastener projections nearest the lane, by a distance that is less than ten percent of the width of the lane.

2. The touch fastener product of claim 1, wherein the fastening face has a portion raised with respect to adjacent regions of the fastening face within the lane, and wherein the layer of adhesive is disposed on an outer surface of the raised portion of the fastening face.

3. The touch fastener product of claim 1, further comprising a series of discrete, non-fastening stems extending from the base strip through the layer of adhesive within the lane, the resin stems forming portions of the single, contiguous mass of resin.

4. The touch fastener product of claim 1, wherein the fields of touch fastener projections define multiple spaced apart lanes, each lane defined between a respective pair of fields, and wherein the layer of adhesive comprises multiple portions of adhesive, each portion disposed within a respective one of the lanes.

5. The touch fastener product of claim 1, wherein each lane is wider, measured between near edges of the fields of fastener projections that the lane separates, than each of the fields of fastener projections nearest the lane.

6. The touch fastener product of claim 1, wherein the layer of adhesive is domed.

7. The touch fastener product of claim 1, wherein the layer of adhesive is of substantially rectangular cross-section.

8. The touch fastener product of claim 1, wherein each field of fastener projections comprises multiple parallel rows of fastener projections.

9. The touch fastener product of claim 1, wherein each field of fastener projections comprises three fastener projection rows.

10. The touch fastener product of claim 1, wherein the fastener projections are of an overall height, measured perpendicularly from the base strip, less than about 0.020 inch.

11. The touch fastener product of claim 1, wherein the lane width is less than about 4 millimeters.

12. The touch fastener product of claim 1, wherein each fastener projection field has a width of less than about 2 millimeters.

13. The touch fastener product of claim 1, wherein the fastener projections are each configured to engage and retain fibers.

14. The touch fastener product of claim 13, wherein the fastener projections each comprise a molded stem extending from the base strip to a head overhanging the base strip.

15. The touch fastener product of claim 14, wherein each fastener projection head extends laterally in opposite directions to two distal tips.

16. The touch fastener product of claim 14, wherein each fastener projection head extends to a distal tip disposed at an elevation of an upper extent of the adhesive layer.

17. A touch fastener product comprising a base strip of resin having a fastening face and a back face, the fastening face having a portion raised with respect to adjacent regions of the fastening face;

touch fastener projections extending from the fastening face of the base strip and arranged as fields of projections disposed on opposite sides of the raised portion of the fastening face, the projections extending from the base strip to a height above the raised portion, and the base strip and fastener projections together forming a single, contiguous mass of resin; and a layer of exposed adhesive disposed on an outer surface of the raised portion of the fastening face.

18. The touch fastener product of claim 17, wherein the outer surface of the raised portion is flat.

19. The touch fastener product of claim 17, wherein the raised portion of the fastening face has a height, measured perpendicular to adjacent portions of the fastening face, that is less than half the height of the projections.

20. The touch fastener product of claim 17, wherein the layer of adhesive has an exposed outer surface disposed below tops of the projections.

21. The touch fastener product of claim 17, wherein the layer of adhesive is domed.

22. The touch fastener product of claim 17, wherein the layer of adhesive is of substantially rectangular cross-section.

23. The touch fastener product of claim 17, wherein the fastener projections are of an overall height, measured perpendicularly from the base strip, less than about 0.020 inch.

24. The touch fastener product of claim 17, wherein the lane width is less than about 4 millimeters.

25. The touch fastener product of claim 17, wherein each fastener projection field has a width of less than about 2 millimeters.

26. The touch fastener product of claim 17, wherein the fastener projections are each configured to engage and retain fibers.

27. The touch fastener product of claim 26, wherein the fastener projections each comprise a molded stem extending from the base strip to a head overhanging the base strip.

28. The touch fastener product of claim 27, wherein each fastener projection head extends laterally in opposite directions to two distal tips.

29. The touch fastener product of claim 27, wherein each fastener projection head extends to a distal tip disposed at an elevation of an upper extent of the adhesive layer.

30. The touch fastener product of claim 17, wherein each field of fastener projections comprises multiple parallel rows of fastener projections.

31. The touch fastener product of claim 30, wherein each field of fastener projections comprises three fastener projection rows.

* * * * *